US011475821B2

(12) United States Patent
Matsueda

(10) Patent No.: US 11,475,821 B2
(45) Date of Patent: Oct. 18, 2022

(54) DISPLAY DEVICE

(71) Applicants: Tianma Japan, Ltd., Kanagawa (JP); Wuhan Tianma Micro-Electronics Co., Ltd., Wuhan (CN)

(72) Inventor: Yojiro Matsueda, Kanagawa (JP)

(73) Assignees: TIANMA JAPAN, LTD., Kanagawa (JP); WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 17/024,120

(22) Filed: Sep. 17, 2020

(65) Prior Publication Data

US 2021/0097927 A1 Apr. 1, 2021

(30) Foreign Application Priority Data

Sep. 27, 2019 (JP) ..... JP2019-177389

(51) Int. Cl.
*G09G 3/20* (2006.01)
*G09G 3/3275* (2016.01)

(52) U.S. Cl.
CPC ..... *G09G 3/2074* (2013.01); *G09G 3/3275* (2013.01); *G09G 2310/027* (2013.01); *G09G 2310/0291* (2013.01); *G09G 2320/0233* (2013.01)

(58) Field of Classification Search
CPC ..... G09G 2320/0233; G09G 2310/027; G09G 2320/0276; G09G 2320/0673; G09G 2360/16; G09G 3/3275; G09G 2320/0285; G09G 3/2074
See application file for complete search history.

(56) References Cited

U.S. PATENT DOCUMENTS

2007/0046601 A1* 3/2007 Shin ..... G09G 3/3607 345/89
2016/0055812 A1* 2/2016 Kobayashi ..... G09G 3/3696 345/690
2018/0233107 A1* 8/2018 Wu ..... G09G 3/3607
2019/0251916 A1* 8/2019 Wu ..... G09G 3/3607

FOREIGN PATENT DOCUMENTS

JP 2012-237828 12/2012

* cited by examiner

*Primary Examiner* — Nelson M Rosario
*Assistant Examiner* — Scott D Au
(74) *Attorney, Agent, or Firm* — Nixon & Vanderhye

(57) ABSTRACT

A display device includes a display panel and a control circuit configured to process a signal for the display panel. The control circuit is configured to acquire respective gray levels specifying brightness for a plurality of subpixels in one subpixel row, determine correction amounts to the gray levels for the plurality of subpixels based on distribution of the gray levels and the individual gray levels for the plurality of subpixels, and correct the gray levels for the plurality of subpixels by the correction amounts.

14 Claims, 10 Drawing Sheets

COMPARATIVE EXAMPLE

601

| CLASS NO. | RANGE OF CLASS | DECREMENT |
|---|---|---|
| 0 | 0—135 | 0 |
| 1 | 136—223 | -1 |
| 2 | 224—255 | -2 |

GRAY LEVEL CORRECTION TABLE

FIG. 6

603

| CLASS NO. | RANGE OF CLASS | DECREMENT |
|---|---|---|
| 0 | 0—110 | 0 |
| 1 | 111—186 | -1 |
| 2 | 187—234 | -2 |
| 3 | 235—255 | -3 |

GRAY LEVEL CORRECTION TABLE

FIG. 7

COMPARATIVE EXAMPLE

606

| RANGE INCLUDING VALUE OF INDICATOR | CORRECTION TABLE TO BE SELECTED |
|---|---|
| RANGE 0 | 0 |
| RANGE 1 | 1 |
| RANGE 2 | 2 |

GRAY LEVEL CORRECTION TABLE MANAGEMENT TABLE

COMPARATIVE EXAMPLE

COMPARATIVE EXAMPLE

COMPARATIVE EXAMPLE

DISPLAY DEVICE

CROSS-REFERENCE TO RELATED APPLICATIONS

This non-provisional application claims priority under 35 U.S.C. § 119(a) on Patent Application No. 2019-177389 filed in Japan on Sep. 27, 2019, the entire content of which is hereby incorporated by reference.

BACKGROUND

This disclosure relates to a display device.

An active matrix display device includes pixel circuits including one or more switching transistors and a control circuit for controlling the pixel circuits. The control circuit controls the brightness of individual pixels by controlling the pixel circuits in accordance with image data received from the external. The data driver for writing data specifying the brightness of the pixels to the pixel circuits drives a large number of analog amplifiers with a common internal power supply. For this reason, differences in output among the analog amplifiers or an insufficient write because of a variation in load may occur, depending on the image to be displayed (data distribution therefor).

SUMMARY

A display device according to an aspect of this disclosure includes a display panel and a control circuit configured to process a signal for the display panel. The control circuit is configured to acquire respective gray levels specifying brightness for a plurality of subpixels in one subpixel row, determine correction amounts to the gray levels for the plurality of subpixels based on distribution of the gray levels and the individual gray levels for the plurality of subpixels, and correct the gray levels for the plurality of subpixels by the correction amounts.

It is to be understood that both the foregoing general description and the following detailed description are exemplary and explanatory and are not restrictive of this disclosure.

BRIEF DESCRIPTION OF THE DRAWINGS

FIG. 6 provides a configuration example of a gray level correction table;

FIG. 7 provides another configuration example of a gray level correction table;

EMBODIMENTS

Figure 1:
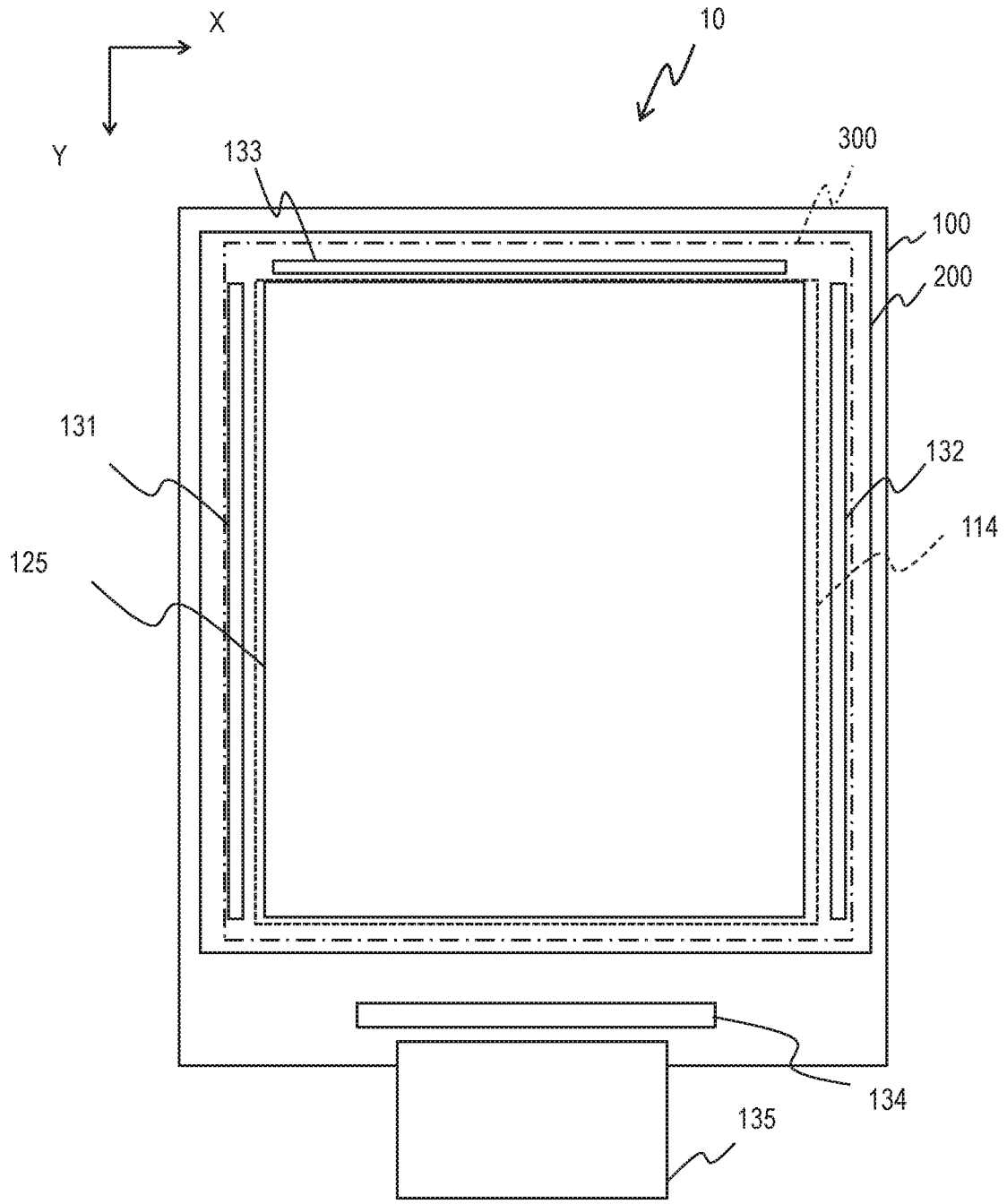
FIG. 1 schematically illustrates a configuration example of an OLED display device.

Hereinafter, embodiments of this disclosure will be described with reference to the accompanying drawings. It should be noted that the embodiments are merely examples to implement the features of this disclosure and are not to limit the technical scope of this disclosure. Elements common to the drawings are denoted by the same reference signs.

A data driver drives a large number of analog amplifiers with a common internal power supply. For this reason, differences in output among the analog amplifiers or an insufficient write because of a variation in load may occur, depending on the image to be displayed (data distribution therefor). These phenomena may cause deviation of the brightness from the intended brightness to a specific pixel in a displayed image.

The deviation of the brightness in the image could be corrected by enhancing the internal power supply of the data driver or reducing the output impedance of the analog amplifiers. However, the power consumption of the display device will increase, which is undesirable particularly for display devices to be used in mobile devices.

The display device disclosed herein determines a correction amount based on the gray level of the specific pixel and changes the gray level by the correction amount. This configuration reduces the differences in brightness among pixels that should not exist, without increasing the power consumption of the control circuit.

Configuration of Display Device

An overall configuration of the display device in the embodiments is described with reference to FIG. 1. The elements in the drawings may be exaggerated in size or shape for clear understanding of the description. In the following, an organic light-emitting diode (OLED) display device is described as an example of the display device; however, the features of this disclosure are applicable to any kind of display devices other than OLED display devices, such as liquid crystal display devices and quantum-dot display devices.

FIG. 1 schematically illustrates a configuration example of an OLED display device 10. The OLED display device 10 includes an OLED display panel and a control circuit. The OLED display panel includes a thin film transistor (TFT) substrate 100 on which OLED elements (light-emitting elements) are provided, an encapsulation substrate 200 for encapsulating the OLED elements, and a bond (glass frit sealer) 300 for bonding the TFT substrate 100 with the encapsulation substrate 200. The space between the TFT substrate 100 and the encapsulation substrate 200 is filled with dry nitrogen, for example, and sealed up with the bond 300. The encapsulation substrate 200 is an example of a structural encapsulation unit; thin film encapsulation (TFE) can be employed.

In the periphery of a cathode electrode region 114 outer than the display region 125 of the TFT substrate 100, a scanning driver 131, an emission driver 132, a protection circuit 133, and a driver integrated circuit (IC) 134 are provided. The driver IC 134 is connected to the external devices via flexible printed circuits (FPC) 135. The scanning driver 131, the emission driver 132, the protection circuit 133, and the driver IC 134 are included in the control circuit.

The scanning driver 131 drives scanning lines on the TFT substrate 100. The emission driver 132 drives emission control lines to control the light emission periods of subpixels. The protection circuit 133 protects the elements from electrostatic discharge. The driver IC 134 is mounted with an anisotropic conductive film (ACF), for example.

The driver IC 134 provides power and timing signals (control signals) to the scanning driver 131 and the emission driver 132 and further, provides data signals to data lines. In other words, the driver IC 134 has a display control function. As will be described later, the driver IC 134 has a function to correct the gray level of a specific pixel in an image to be displayed.

In FIG. 1, the axis extending from the left to the right is referred to as X-axis and the axis extending from the top to the bottom is referred to as Y-axis. The scanning lines extend along the X-axis. The pixels or subpixels disposed in a line along the X-axis within the display region 125 are referred to as a pixel row or subpixel row; the pixels or subpixels disposed in a line along the Y-axis within the display region 125 are referred to as a pixel column or subpixel column.

Configuration of Pixel Circuit

Figure 2A:
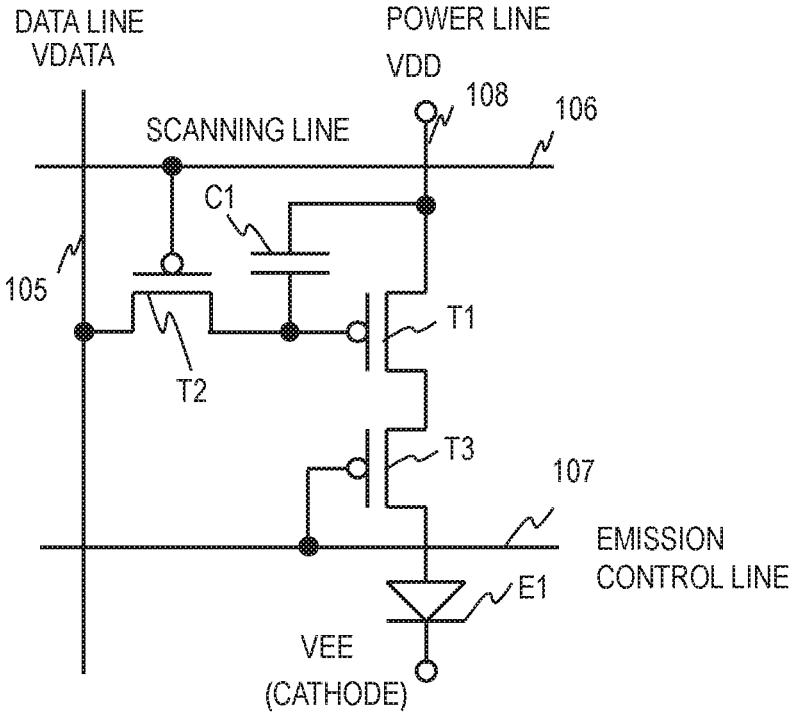
FIG. 2A illustrates a configuration example of a pixel circuit.

A plurality of pixel circuits are fabricated on the TFT substrate 100 to control electric current to be supplied to the anode electrodes of OLED elements E1. FIG. 2A illustrates a configuration example of a pixel circuit. Each pixel circuit includes a driving transistor T1, a selection transistor T2, an emission transistor T3, and a storage capacitor C1. The pixel circuit controls light emission of an OLED element E1. The transistors are thin film transistors (TFTs). The cathode of an OLED element E1 is supplied with a power supply potential VEE.

The selection transistor T2 is a switch for selecting the subpixel. The gate terminal of the selection transistor T2 is connected with a scanning line 106. One of the source/drain terminals is connected with a data line 105 and the other source/drain terminal is connected with the gate terminal of the driving transistor T1.

The driving transistor T1 is a transistor (driving TFT) for driving the OLED element E1. The gate terminal of the driving transistor T1 is connected with the source/drain terminal of the selection transistor T2. One of the source/drain terminals of the driving transistor T1 is connected with a power line 108 for supplying a power supply potential VDD. The other source/drain terminal is connected with the source/drain of the emission transistor T3. The storage capacitor C1 is provided between the gate terminal and one of the source/drain terminals of the driving transistor T1.

The emission transistor T3 is a switch for controlling supply/stop of the driving current to the OLED element E1. The gate terminal of the emission transistor T3 is connected with an emission control line 107. One of the source/drain terminals of the emission transistor T3 is connected with the source/drain terminal of the driving transistor T1. The other source/drain terminal of the emission transistor T3 is connected with the OLED element E1.

Next, operation of the pixel circuit is described. The scanning driver 131 outputs a selection pulse to the scanning line 106 to turn on the selection transistor T2. The data voltage supplied from the driver IC 134 through the data line 105 is stored to the storage capacitor C1. The storage capacitor C1 holds the stored voltage during the period of one frame. The conductance of the driving transistor T1 changes in an analog manner in accordance with the stored voltage, so that the driving transistor T1 supplies a forward bias current corresponding to a light emission level to the OLED element E1.

The emission transistor T3 is located on the supply path of the driving current. The emission driver 132 outputs a control signal to the emission control line 107 to control ON/OFF of the emission transistor T3. When the emission transistor T3 is ON, the driving current is supplied to the OLED element E1. When the emission transistor T3 is OFF, this supply is stopped. The lighting period (duty ratio) in the period of one frame can be controlled by controlling ON/OFF of the transistor T3.

Figure 2B:
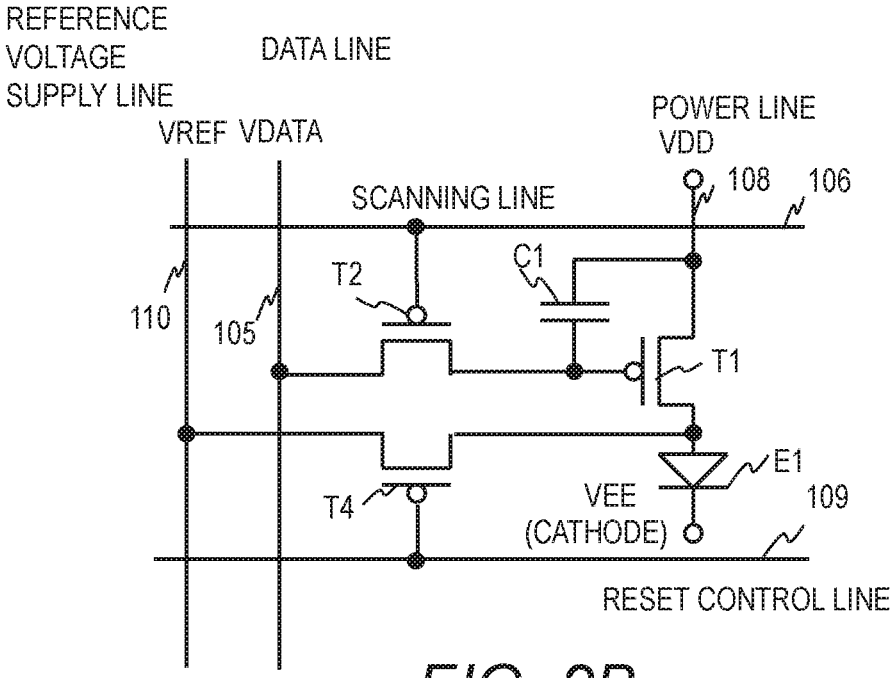
FIG. 2B illustrates another configuration example of a pixel circuit.

FIG. 2B illustrates another configuration example of a pixel circuit. This pixel circuit includes a reset transistor T4 in place of the emission transistor T3 in FIG. 2A. The reset transistor T4 controls the electric connection between a reference voltage supply line 110 and the anode of the OLED element E1. This control is performed in accordance with a reset control signal supplied to the gate of the reset transistor T4 through a reset control line 109. For example, either the emission driver 132 or the driver IC 134 supplies this reset control signal.

The reset transistor T4 can be used for various purposes. For example, the reset transistor T4 can be used to reset the anode electrode of the OLED element E1 once to a sufficiently low voltage that is lower than the black signal level in order to prevent crosstalk caused by leakage current between OLED elements E1.

The reset transistor T4 can also be used to measure a characteristic of the driving transistor T1. For example, the voltage-current characteristic of the driving transistor T1 can be accurately measured by measuring the current flowing from the power line 108 (VDD) to the reference voltage supply line 110 (VREF) under the bias conditions selected so that the driving transistor T1 will operate in the saturated region and the reset transistor T4 will operate in the linear region. If the differences in voltage-current characteristic among the driving transistors T1 in pixel circuits are compensated for by generating data signals at an external circuit, a highly-uniform display image can be attained.

In the meanwhile, the voltage-current characteristic of the OLED element E1 can be accurately measured by applying a voltage to light the OLED element E1 from the reference voltage supply line 110 when the driving transistor T1 is OFF and the reset transistor T4 is operating in the linear region. In the case where the OLED element E1 is deteriorated because of long-term use, for example, if the deterioration is compensated for by generating a data signal at an external circuit, the display device can have a long life spun.

The circuit configurations in FIGS. 2A and 2B are examples; the pixel circuit may have a different circuit configuration. Although the pixel circuits in FIGS. 2A and 2B include p-channel TFTs, the pixel circuit may employ n-channel TFTs.

Configuration of Driver IC

Figure 3:
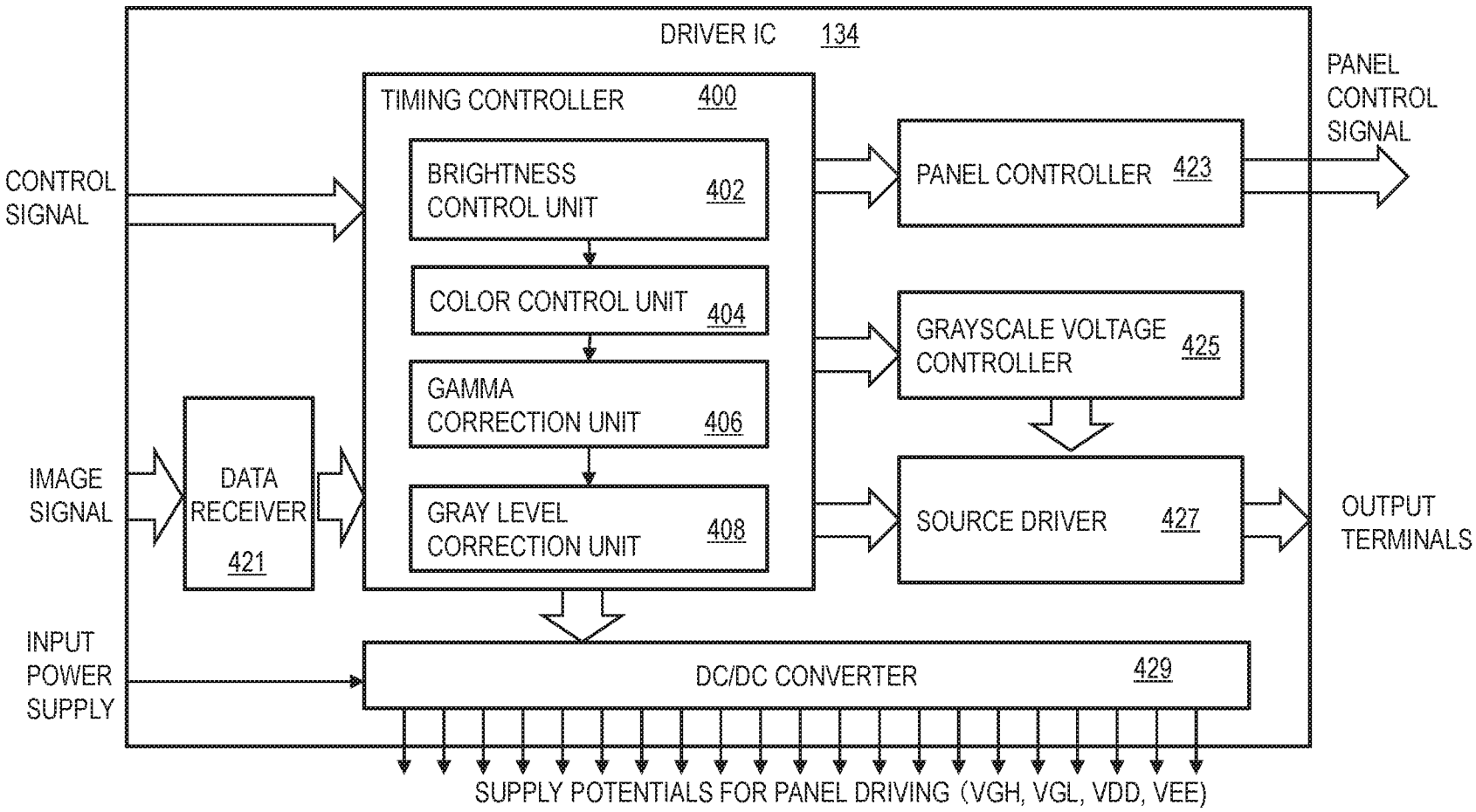
FIG. 3 illustrates logical elements of a driver IC.

FIG. 3 illustrates logical elements of the driver IC 134. The driver IC 134 includes a timing controller 400, a data receiver 421, a panel controller 423, a grayscale voltage controller 425, a source driver 427, and a DC/DC converter 429. The timing controller 400 includes a brightness control unit 402, a color control unit 404, a gamma correction unit 406, and a gray level correction unit 408. These function units can be implemented by logic circuits (hardware) or a combination of a processor (hardware) and software to be executed by the processor.

The timing controller 400 controls the timing of the scanning signal, the data signal, and a signal for controlling light emission of OLEDs based on a control signal and an image signal (image data) from the external. The timing controller 400 supplies information required for gamma correction to the grayscale voltage controller 425 and gray levels specifying the brightness of individual subpixels to the source driver 427.

The data receiver 421 receives an image signal in conformity with the regulations specified by Mobile Industry Processor Interface (MIPI) Alliance, for example, and outputs the received image signal to the timing controller 400.

In the timing controller 400, the brightness control unit 402 performs brightness adjustment to the data for each pixel (specifying the brightness of each subpixel) included in the received image signal. The color control unit 404 performs chromatic adjustment to the brightness-adjusted data for each pixel. The gamma correction unit 406 performs gamma correction to the chromatically adjusted data for each pixel. The gray level correction unit 408 detects a specific pixel from the gamma-corrected pixels and corrects the data for the detected pixel. The details of the correction by the gray level correction unit 408 will be described later.

The panel controller 423 generates signals (panel control signals) for controlling the panel, such as the scanning signal and the light emission control signal, and outputs the generated signals to the scanning driver 131 and the emission driver 132. The grayscale voltage controller 425 outputs analog reference voltages for individual colors of red, green, and blue so that the voltage (out of 256 levels, for example) at each data output terminal will meet a gamma characteristic having a predetermined relation between the gray level and the brightness at a subpixel.

The source driver 427 generates data signals based on the gray levels specified by the data for subpixels that have been corrected by the gray level correction unit 408 and the reference voltages from the grayscale voltage controller 425 and outputs the generated signals to output terminals. The DC/DC converter 429 generates potentials (VGH, VGL) for the clock signal (gate signal) to be supplied to the scanning circuit, a power-supply potential VDD for the pixel circuits (a power-supply voltage to be supplied to the anodes of the OLED elements), and a power-supply potential VEE (a power-supply potential to be supplied to the cathodes of the OLED elements).

Gray Level Correction

Figure 4:
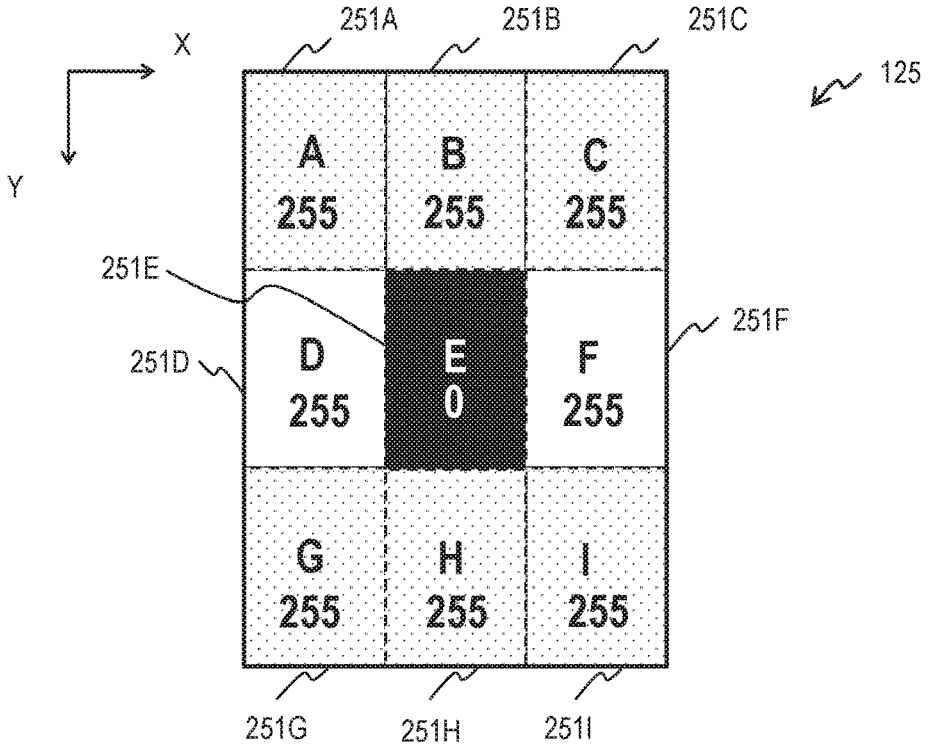
FIG. 4 schematically illustrates brightness of subregions of the display region of a comparative example when the display region displays an image of a specific pattern.

Hereinafter, correction to data for the pixels is described. This correction is performed by the gray level correction unit 408. FIG. 4 schematically illustrates the brightness of subregions 251A to 251I of the display region 125 of a comparative example when the display region 125 displays an image of a specific pattern. The subregions 251A to 251I have the identical shapes. The image of the specific pattern is composed of a black rectangle at the center and a white region surrounding the black rectangle. The subregion 251E at the center of the display region 125 corresponds to the black region and the subregions 251A to 251D and 251F to 251I surrounding the subregion 251E correspond to the white region.

The numeral in each subregion in FIG. 4 indicates the gray level assigned to the subpixels therein. The gray level is a value indicating the brightness of each subpixel provided from the timing controller to the source driver. The configuration of the driver IC that provides the comparative example illustrated in FIG. 4 is obtained by excluding the gray level correction unit 408 from the driver IC 134 in this embodiment illustrated in FIG. 3.

In the comparative example in FIG. 4, the gray levels assigned to all subpixels in the subregion 251E are 0 (the darkest) and the gray levels assigned to all subpixels in the other subregions 251A to 251D and 251F to 251I are 255 (the brightest). In this example, the highest value for the gray level (corresponding to the maximum brightness of a subpixel) is 255.

In the comparative example in FIG. 4, the brightness of the white subregions 251D and 251F are higher than the brightness of the other white subregions 251A to 251C and 251G to 251I. The differences among the potentials output from the driver IC 134 because of the data distribution can be considered as one of the causes. The source driver drives a large number of analog amplifiers with a common internal power supply. The source driver outputs data potentials for a plurality of selected subpixels (corresponding to a subpixel row) simultaneously from the analog amplifiers. Accordingly, output differences among analog amplifiers may occur, depending on the distribution of the input gray levels for the plurality of subpixels.

In the comparative example in FIG. 4, each subpixel row in the white subregions 251A to 251C is composed of subpixels assigned the same gray level of 255. In similar, each subpixel row in the white subregions 251G to 251I is composed of subpixels assigned the same gray level of 255.

However, each subpixel row in the subregions 251D to 251F is composed of subpixels consecutive in the subregion 251D, subpixels consecutive in the subregion 251E, and subpixels consecutive in the subregion 251F. The subpixels in the subregions 251D and 251F are assigned the gray level of 255 (the maximum value) and the subpixels in the subregion 251E are assigned the gray level of 0 (the minimum value).

Because of the subregion 251E assigned a low gray level, the actual brightness of the subpixels in the subregions 251D and 251F becomes higher than the brightness of the other subregions 251A to 251C and 251G to 251I assigned the gray level of 255. In other words, the actual brightness of the subpixels in the subregions 251D and 251F deviates from the brightness specified by the gray level of 255.

Figure 5:
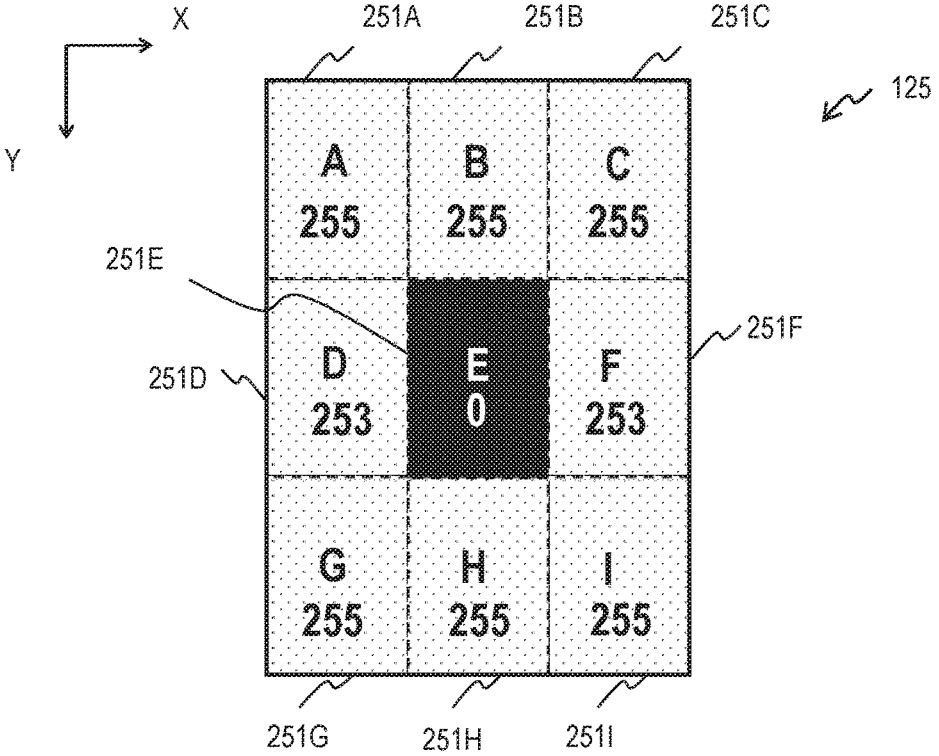
FIG. 5 illustrates the gray levels for the subpixels the gray level correction unit provides to the source driver in the driver IC in an embodiment of this disclosure.

FIG. 5 illustrates the gray levels for the subpixels the gray level correction unit 408 provides to the source driver 427 in the driver IC 134 in this embodiment. The gray levels the gray level correction unit 408 receives from the gamma correction unit 406 for the subpixels are the same as those in the comparative example in FIG. 4. The gray level correction unit 408 lowers the gray level for the subregions 251D and 251E from 255 by 2. The gray levels for the subregions 251D and 251E provided to the source driver 427 are 253.

The actual brightness of the subregions 251D and 251F is lowered by assigning the gray level lowered from 255 by a predetermined amount as illustrated in FIG. 5. As a result, the deviation of the brightness observed in the subregions 251D and 251F when gray level correction is not performed can be made small and the differences in brightness among the regions that should not exist can be made small.

In an example, the gray level correction unit 408 determines (detects) a subpixel (correction target subpixel) in need of correction of gray level from the data for one pixel row (subpixel row). The gray level correction unit 408 has a memory and stores the data for one pixel row forwarded from the gamma correction unit 406. The gray level correction unit 408 analyses the data for one pixel row and determines the subpixel where the actual brightness is anticipated to deviate from the brightness specified by the gray level to be a correction target subpixel.

There are various methods for determining (detecting) a region (correction target region) where the actual brightness is anticipated to deviate from the brightness specified by the gray level within a pixel row. The gray level correction unit 408 can determine a correction target region by any method. As described above, deviation of brightness occurs in a pixel row having high contrast. Accordingly, the gray level correction unit 408 can determine a correction target region for example by selecting a region where the contrast (brightness ratio) and the gray levels are higher than specified conditions from a pixel row and correct the gray levels for the subpixels in the correction target region. The brightness of a pixel can be calculated from the gray levels (brightness) for the subpixels constituting the pixel.

The gray level correction unit 408 can restrict the pixel row in need of correction to a pixel row in a specific color and/or a specific brightness pattern. For example, the gray level correction unit 408 can select a pixel row in need of correction from pixel rows composed of achromatic pixels whose constituent subpixels are assigned the same gray level or subpixels composed of pixels in two colors. The pixel row in need of correction can be restricted to a pixel row having one section (region) in the same color and one or two sections in the same color but having brightness higher than the former section, like the pattern in FIG. 5.

The gray level correction unit 408 determines the correction amount to the gray level for each subpixel based on the assigned gray level. Hence, the brightness can be corrected by simple processing without increase in power consumption. For example, the gray level correction unit 408 may hold a correction table defining relations between a gray level and a correction amount. The gray level correction unit 408 consults the gray level correction table to determine the correction amount to the gray level assigned to a subpixel. Note that the gray level correction unit 408 can employ any method to determine the correction amount.

FIG. 6 provides a configuration example 601 of a gray level correction table. The gray level correction table 601 associates a plurality of classes of gray level ranges with correction amounts, more specifically, associates each class with a decrement for the gray levels belonging to the class. The gray level correction unit 408 determines the correction amount to the gray level of each subpixel in the subpixel row determined to be subject to correction.

The gray level correction table 601 divides the full grayscale range into three classes of 0, 1, and 2 and assigns a decrement to each class. The range of the gray levels defined in the gray level correction table 601 is from level 0 to level 255.

The class 0 of the lowest gray levels (the lowest brightness) includes level 0 to level 135 and the class 2 of the highest gray levels (the highest brightness) includes level 224 to level 255. The correction amount assigned to the lowest class is 0 and the subpixels at the gray levels included in the class 0 are not subject to correction.

The gray level correction table 601 assigns a larger correction amount (in absolute value) to a class of higher levels. The correction amounts become smaller from the one for the brightest class to the one for the darkest class. The absolute values of the correction amounts are differed by 1: the class 2 of the highest levels is assigned −2 and the class 1 of the middle levels is assigned −1. Assigning a larger correction amount to a class of higher levels effectively reduces the variation in brightness caused by the distribution of brightness, while moderating the change of the displayed image caused by the correction.

When the OLED display device 10 has a gamma characteristic based on a gamma value of 2.2, the class 0 in the gray level correction table 601 corresponds to a brightness range from 0% to 25%, the class 1 corresponds to a brightness range from 25% to 75%, and the class 2 corresponds to a brightness range from 75% to 100%. If the anticipated variation in brightness is approximately 2%, correction in the amount of two levels will be appropriate.

FIG. 7 provides another configuration example 603 of the gray level correction table. The gray level correction table 603 defines a class set different from the class set in the gray level correction table 601 in FIG. 6. Specifically, the gray level correction table 603 divides the full grayscale range into four classes of 0 to 3 and assigns a correction amount to each class. The range of the gray levels defined in the gray level correction table 603 is from level 0 to level 255.

The class 0 of the lowest gray levels (the lowest brightness) includes level 0 to level 110; the next class 1 includes level 111 to level 186; the next class 2 includes level 187 to level 234; and the class 3 of the highest gray levels (the highest brightness) includes level 235 to level 255.

The correction amount assigned to the lowest class is 0 and the subpixels at the gray levels included in the class 0 are not subject to correction. The gray level correction table 603 assigns a larger correction amount (in absolute value) to a class of higher levels. The correction amounts become smaller from the one for the brightest class to the one for the darkest class. The absolute values of the correction amounts are differed by 1: the class 1 is assigned −1, the class 2 is assigned −2, and the class 3 of the highest levels is assigned −3. Assigning a larger correction amount to a class of higher levels effectively reduces the variation in brightness caused by the distribution of brightness, while moderating the change of the displayed image caused by the correction.

When the OLED display device 10 has a gamma characteristic based on a gamma value of 2.2, the class 0 in the gray level correction table 603 corresponds to a brightness range from 0% to 16.6%, the class 1 corresponds to a brightness range from 16.6% to 50%, the class 2 corresponds to a brightness range from 50% to 83.3%, and the class 3 corresponds to a brightness range from 83.3% to 100%. If the anticipated variation in brightness is approximately 3%, correction in the amount of three or four levels will be appropriate.

Figure 8:
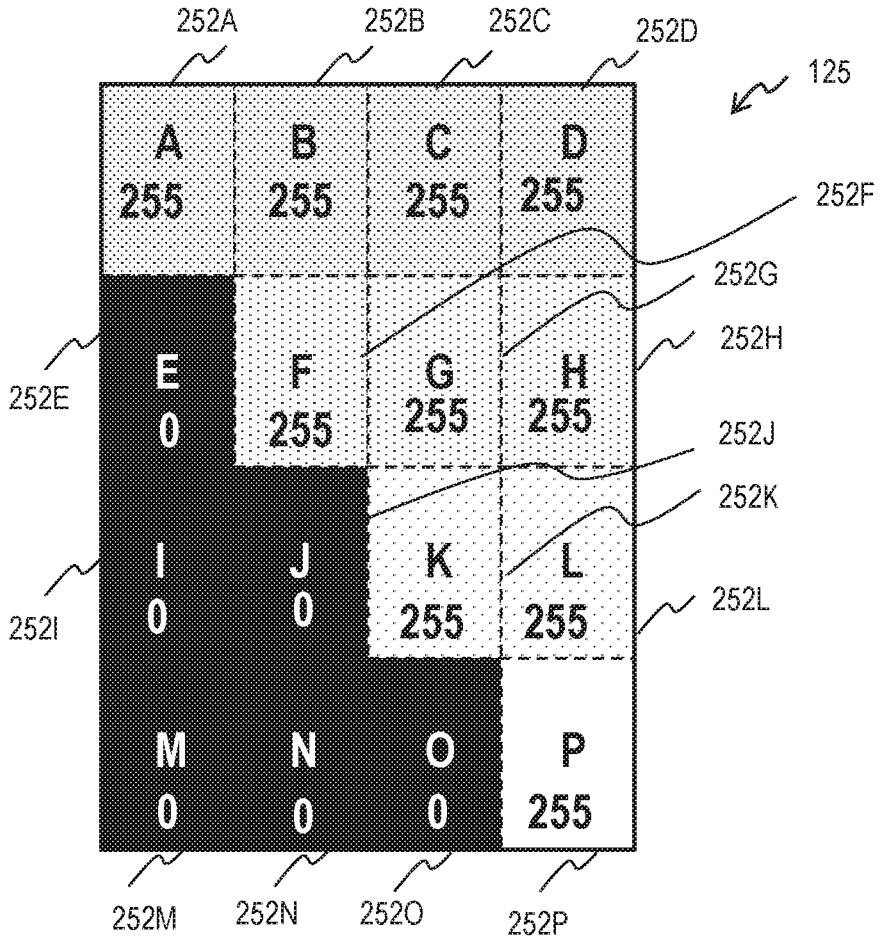
FIG. 8 schematically illustrates brightness of subregions of the display region of a comparative example when the display region displays an image of another specific pattern.

Next, another example of an image in which deviation of brightness from the brightness specified by a gray level occurs. FIG. 8 schematically illustrates the brightness of subregions 252A to 252P of the display region 125 of a comparative example when the display region 125 displays an image of a specific pattern. The subregions 252A to 252P have the identical shapes.

The image of the specific pattern is composed of black subregions 252E, 252I, 252J, 252M, 252N, and 252O where the gray level is 0 (the darkest) and the other white subregions where the gray level is 255 (the brightest). The numeral in each subregion in FIG. 8 indicates the gray level assigned to the subpixels therein. In this example, the highest value for the gray level (corresponding to the maximum brightness of a subpixel) is 255. Each pixel row is composed of consecutive white pixels only or consecutive black pixels and consecutive white pixels.

The gray level is a value indicating the brightness of each subpixel provided from the timing controller to the source driver. The configuration of the driver IC that provides the comparative example illustrated in FIG. 8 is obtained by excluding the gray level correction unit 408 from the driver IC 134 in this embodiment illustrated in FIG. 3.

In the comparative example in FIG. 8, the brightness of the white subregions 252A to 252D are the same. The brightness of the white subregions 252F to 252H are the same. The brightness of the white subregions 252K and 252L are the same.

In the comparative example in FIG. 8, the brightness of the white subregion 252P is higher than the brightness of any of the other white subregions 252A to 252D, 252F to 252H, and 252K and 252L. The brightness of the subregions 252F to 252H is the second highest after the brightness of the subregions 252K and 252L. The brightness of the subregions 252A to 252D is the lowest.

In the comparative example in FIG. 8, the pixels (subpixels) in the subregion 252P are included in the same pixel rows (subpixel rows) as the pixels (subpixels) in the black subregions 252M to 252O. The pixels in the subregions 252K and 252L are included in the same pixel rows as the pixels in the black subregions 252I and 252J. The pixels in the subregions 252F to 252H are included in the same pixel rows as the pixels in the black subregion 252E. The pixels in the subregions 252A to 252D are included in the pixel rows composed of pixels assigned a gray level of 255.

In the comparative example in FIG. 8, the brightness of the white pixels in the pixel rows that also include black pixels is higher than the brightness of the white pixels in the pixel rows that include only white pixels. Furthermore, the brightness of white pixels is higher when the number of black pixels in the same pixel row is larger. As understood from the above, the actual brightness of the subpixels in the subregions 252F to 252H, 252K, 252L, and 252P deviates from the brightness specified by the gray level of 255 and the deviation is larger when the number of black pixels in the same pixel row is larger.

Figure 9:
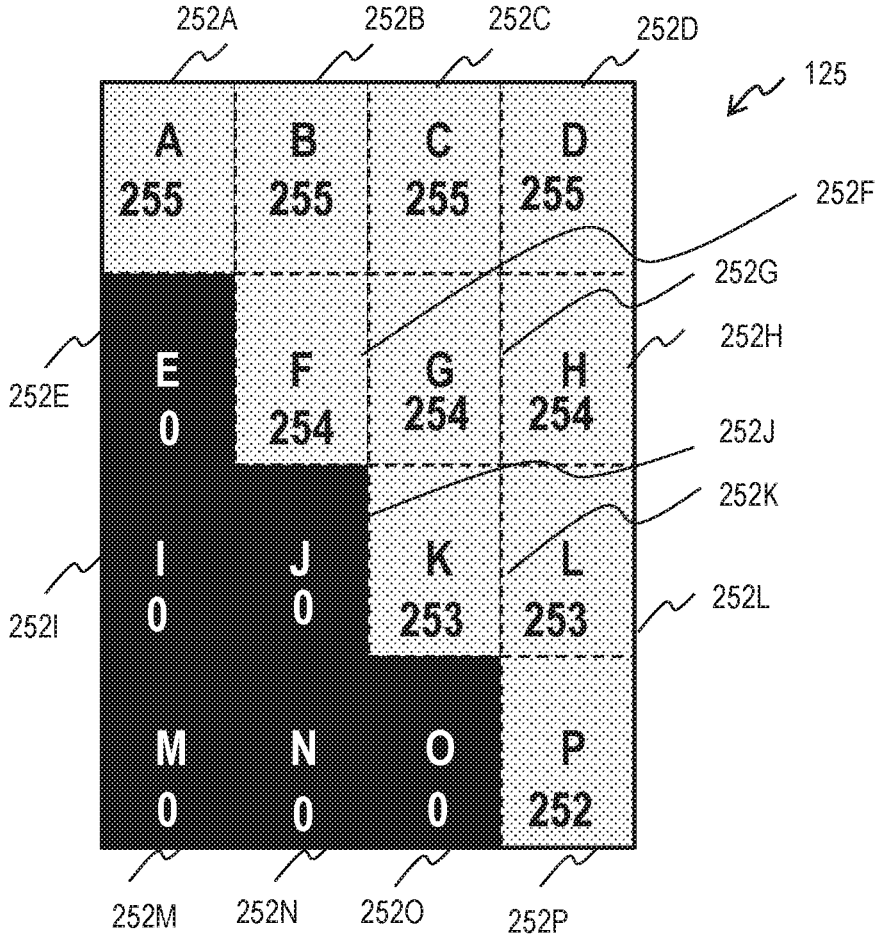
FIG. 9 illustrates the gray levels for the subpixels the gray level correction unit provides to the source driver in the driver IC in an embodiment of this disclosure.

FIG. 9 illustrates the gray levels for the subpixels the gray level correction unit 408 provides to the source driver 427 in the driver IC 134 in this embodiment. The gray levels the gray level correction unit 408 receives from the gamma correction unit 406 for the subpixels are the same as those in the comparative example in FIG. 8. The gray level correction unit 408 lowers the gray levels for the subregion 252P from 255 by 3, lowers the gray levels for the subregions 252K and 252L from 255 by 2, and lowers the gray levels for the subregions 252F to 252H from 255 by 1.

As illustrated in FIG. 9, lowering the gray levels for the subregions 252F to 252H, 252K, 252L, and 252P by predetermined decrements reduces the deviation of the actual brightness of each subregion from the brightness specified by the gray levels. As a result, the differences in brightness among the regions that should not exist can be made small.

Figures 10, 11:
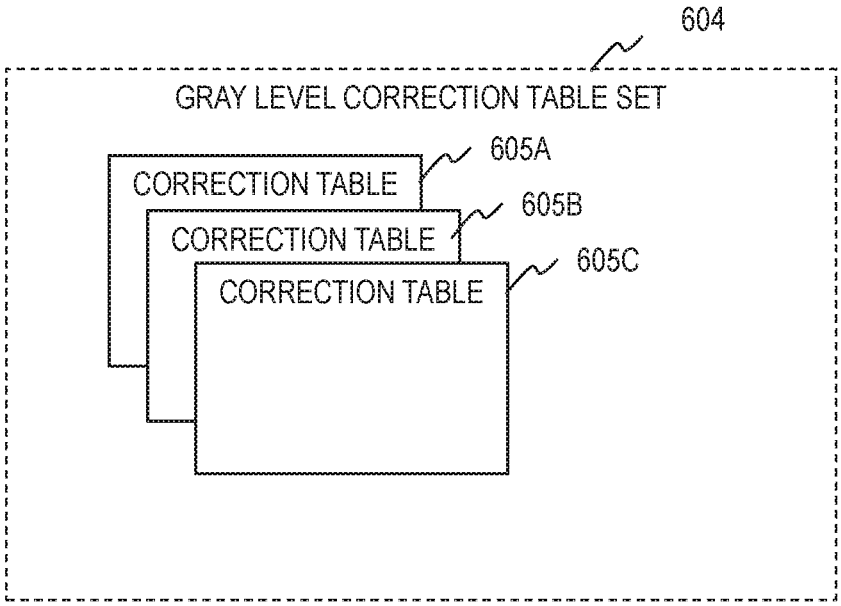
FIG. 10 provides an example of gray level correction table set held by the gray level correction unit.
FIG. 11 provides a configuration example of a gray level correction table management table.

To perform the correction as illustrated in FIG. 9, the gray level correction unit 408 can use a plurality of gray level correction tables. FIG. 10 illustrates an example of a gray level correction table set 604 held by the gray level correction unit 408. The gray level correction table set 604 includes gray level correction tables 605A to 605C. Each of the gray level correction tables 605A to 605C associates classes of gray level ranges with correction amounts (decrements) to the gray levels belonging to the class, as described with reference to FIGS. 6 and 7.

The pixel (subpixel) to show a large deviation of brightness needs a larger correction amount. In an example, the gray level correction tables 605A to 605C are configured to meet different amounts of deviation of brightness. The gray level correction tables 605A to 605C specify correction amounts for different gray level class sets.

The gray level correction tables 605A to 605C define different numbers of gray level range classes and assign correction amounts differing by 1 to the classes as described with reference to FIGS. 6 and 7. The correction amount assigned to the class of the lowest gray levels is 0. The largest correction amount in a gray level correction table is larger when the number of classes therein is larger.

For example, the gray level correction table 605A defines two classes and assigns a correction amount of 0 to the class of lower gray levels and assigns a correction amount of −1 to the class of higher gray levels. The gray level correction table 605B defines three classes and assigns correction amounts of 0, −1, and −2 to the classes from the class of the lowest gray levels to the class of the highest gray levels. The gray level correction table 605C defines four classes and assigns correction amounts of 0, −1, −2, and −3 to the classes from the class of the lowest gray levels to the class of the highest gray levels.

The gray level correction unit 408 selects a gray level correction table to be used based on the brightness distribution (gray levels for the subpixels) in the correction target pixel row. The gray level correction unit 408 calculates a specific indicator, for example an indicator indicating the deviation (the largest amount thereof) of the anticipated actual brightness from the brightness specified by the gray level, and selects a gray level correction table in accordance with the value of the indicator.

When the deviation is larger, a gray level correction table including a larger correction amount is selected. The indicator directly or indirectly indicates a statistical value of the brightness of pixels, such as the average of the brightness of the pixels or the proportion of black pixels (which is equivalent to the proportion of white pixels) in the correction target pixel row. For a pixel row having a low average of brightness or a large proportion of black pixels, a gray level correction table including a larger correction amount is selected.

For example, the gray level correction unit 408 can hold a management table that associates values of the indicator with the gray level correction tables 605A to 605C and consult the management table with the value of the indicator to select a gray level correction table.

FIG. 11 provides a configuration example 606 of a gray level correction table management table. The gray level correction table management table 606 associates value ranges of the indicator with gray level correction tables. When the anticipated deviation according to the indicator is larger, a gray level correction table having a larger number of classes is assigned. The gray level correction unit 408 calculates the value of the indicator of a pixel row and selects the gray level correction table associated with a range including the value. As described above, preparing a plurality of gray level correction tables defining different class sets enables the correction to be more appropriate for the displayed distribution of brightness.

As described above, the deviation of the brightness to be corrected by the gray level correction unit 408 is a phenomenon caused by the output characteristics of the driver IC 134 and accordingly, the amounts of variation of the brightness can be estimated and correction amounts can be set to the driver IC 134 in advance. For this reason, the circuit for correcting the gray levels can be made small in size, so that the gray level correction unit 408 can be included in the driver IC 134.

Like in the foregoing example, the gray level correction unit 408 can determine the correction amount to the gray level of each subpixel in a selected subpixel row (pixel row) based on only the gray levels in the subpixel row without referring to the gray levels for other subpixel rows. The memory area required for the correction is a size for one subpixel row and therefore, the correction can be achieved without preparing a large storage area like a frame memory in the driver IC 134.

Figure 12A:
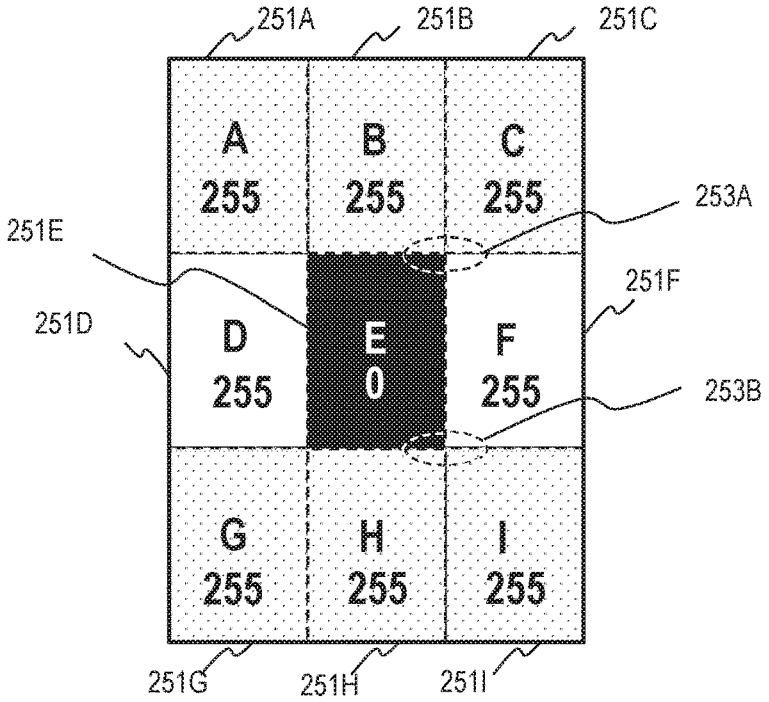
FIG. 12A schematically illustrates brightness of subregions of the display region of a comparative example when the display region displays an image of a specific pattern.

Next, other appearances of deviation of the brightness caused by brightness distribution in a displayed image are described. FIG. 12A schematically illustrates brightness of subregions 251A to 251I of the display region 125 of a comparative example when the display region 125 displays an image of a specific pattern. The brightness of the subregions 251A to 251I are the same as described with reference to FIG. 4.

Although omitted in the description provided with reference to FIG. 4, the subregion 251D may show a line having higher brightness than the other part of the subregion 251D along the boundary with the subregion 251A. The subregion 251F may show another line having higher brightness than the other part of the subregion 251F along the boundary with the subregion 251C.

Further, the subregion 251G may show a line having lower brightness than the other part of the subregion 251G along the boundary with the subregion 251D. The subregion 251H may show another line having lower brightness than the other part of the subregion 251H along the boundary with the subregion 251E. The subregion 251I may show still another line having lower brightness than the other part of the subregion 251I along the boundary with the subregion 251F.

Figure 12B:
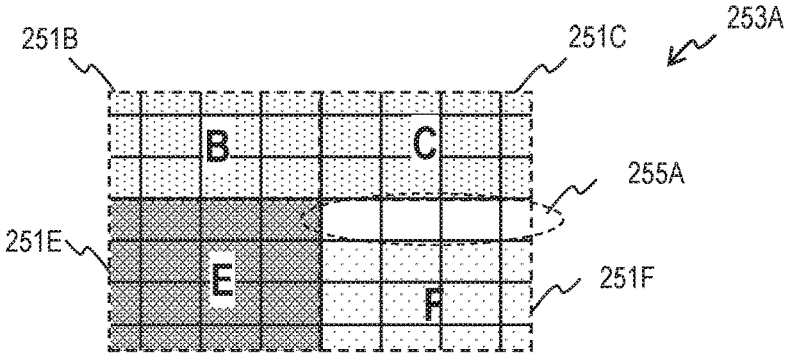
FIG. 12B is an enlarged view of the border area of four subregions in FIG. 12A.

FIG. 12B is an enlarged view of the border area 253A of four subregions 251B, 251C, 251E, and 251F in FIG. 12A. As described with reference to FIG. 4, the brightness of the subregion 251F is higher than the brightness of the subregions 251B and 251C. The brightness of the pixel group (subpixel group) 255A in the subregion 251F that are adjacent to the subregion 251C is higher than the brightness of the other pixels in the subregion 251F.

Although not shown in the drawings, the brightness of the pixel group in the subregion 251D that are adjacent to the subregion 251A is higher than the brightness of the other pixels in the subregion 251D. This pixel group in the subregion 251D is included in the same pixel row as the pixel group 255A in the subpixel region 251F (the data signals for these pixels are written simultaneously).

The subpixel row (fourth subpixel row) including the pixel group 255A consists of two subpixel groups (third subpixel groups) each composed of consecutive subpixels at a gray level of 255 and a subpixel group (fourth subpixel group) composed of consecutive subpixels at a gray level of 0. The subpixel row (third subpixel row) immediately before the subpixel row including the pixel group 255A is composed of subpixels in the subregions 251A, 251B, and 251C and the gray levels for those subpixels are 255. The subpixel row (fifth subpixel row) next to the subpixel row including the pixel group 255A consists of two subpixel groups (fifth subpixel groups) each composed of consecutive subpixels at a gray level of 255 and a subpixel group (sixth subpixel group) composed of consecutive subpixels at a gray level of 0. The subpixel row next to the subpixel row including the pixel group 255A has the same gray level distribution as the subpixel row including the pixel group 255A.

Figure 12C:
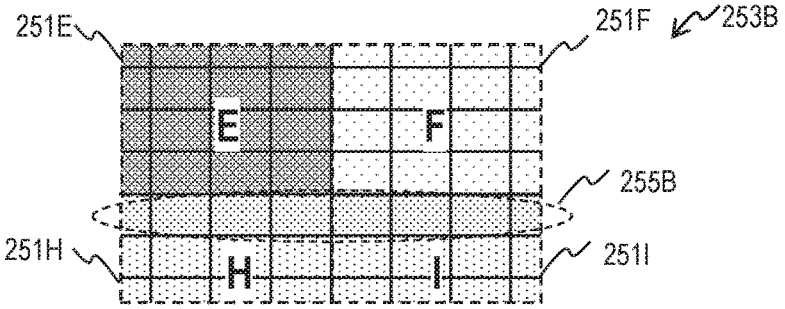
FIG. 12C is an enlarged view of the border area of other four subregions in FIG. 12A.

FIG. 12C is an enlarged view of the border area 253B of four subregions 251E, 251F, 251H, and 251I in FIG. 12A. As described with reference to FIG. 4, the brightness of the subregion 251F is higher than the brightness of the subregions 251H and 251I. The pixel group (subpixel group) 255B includes pixels in the subregion 251H that are adjacent to the subregion 251E and pixels in the subregion 251I that are adjacent to the subregion 251F. The pixel group 255B is included in the same pixel row. The brightness of the pixel group 255B is lower than the brightness of the other pixels in the subregions 251H and 251I.

Although not shown in the drawings, the pixel group in the subregion 251G that are adjacent to the subregion 251D are included in the same pixel row as the pixel group 255B and their brightness is lower than the brightness of the other pixels in the subregion 251G.

The subpixel row (seventh subpixel row) including the pixel group 255B is composed of subpixels at a gray level of 255. The subpixel row (sixth subpixel row) immediately before the subpixel row including the pixel group 255B consists of two subpixel groups (seventh subpixel groups) each composed of consecutive subpixels at a gray level of 255 and a subpixel group (eighth subpixel group) composed of consecutive subpixels at a gray level of 0. The subpixel row (eighth subpixel row) next to the subpixel row including the pixel group 255B is composed of subpixels at a gray level of 255.

Figure 13A:
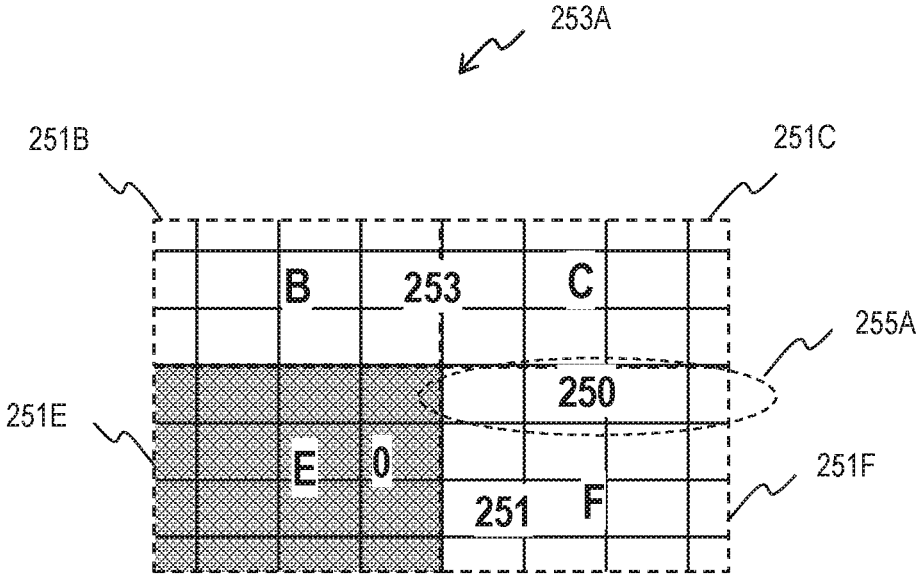
FIG. 13A illustrates the gray levels the gray level correction unit provides to the source driver for the subpixels in the border area in FIG. 12B.

FIG. 13A illustrates the gray levels the gray level correction unit 408 provides to the source driver 427 for the subpixels in the border area 253A. The gray levels the gray level correction unit 408 receives from the gamma correction unit 408 for the subpixels are the same as those in the comparative example in FIG. 12A. The gray level correction unit 408 lowers the gray levels for the subregions 251B and 251C from 255 by 2 (first decrement). The gray levels for the subregions 251B and 251C to be provided to the source driver 427 are 253.

The gray level correction unit 408 lowers the gray levels for the subpixel group 255A in the subregion 251F that are adjacent to the subregion 251C from 255 by 5 (the second decrement). The gray level correction unit 408 lowers the gray levels for the other subpixels in the subregion 251F from 255 by 4 (the third decrement).

Although not shown in the drawings, the gray level correction unit 408 performs correction to the subregion 251D in the same way as the correction to the subregion 251F. In other words, the gray level correction unit 408 lowers the gray levels for the subpixels in the subregion 251D that are adjacent to the subregion 251A from 255 by 5. The gray level correction unit 408 lowers the gray levels for the other subpixels in the subregion 251D from 255 by 4.

Figure 13B:
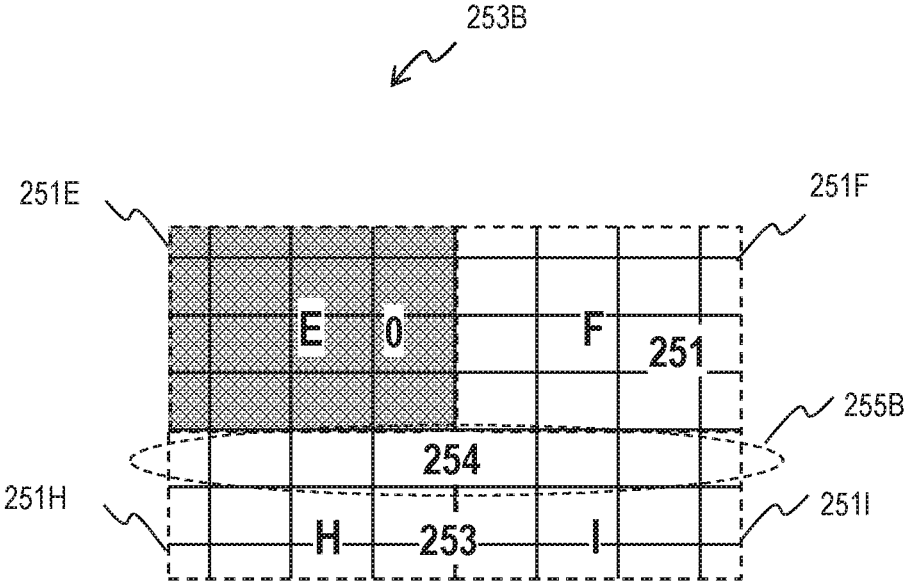
FIG. 13B illustrates the gray levels the gray level correction unit provides to the source driver for the subpixels in the border area in FIG. 12C.

FIG. 13B illustrates the gray levels the gray level correction unit 408 provides to the source driver 427 for the subpixels in the border area 253B. The gray levels the gray level correction unit 408 receives from the gamma correction unit 408 for the subpixels are the same as those in the comparative example in FIG. 12A. The gray level correction unit 408 lowers the gray levels for the subpixel group 255B in the subregions 251H and 251I from 255 by 1 (fifth decrement). Although not shown in the drawings, the gray level correction unit 408 lowers the gray levels for the subpixels in the subregion 251G that are adjacent to the subregion 251D from 255 by 1.

The gray level correction unit 408 lowers the gray levels for the other subpixels in the subregions 251H and 251I from 255 by 2 (sixth decrement). Although not shown in the drawings, the gray level correction unit 408 lowers the gray levels for the subpixels in the subregion 251G other than the subpixels adjacent to the subregion 251D from 255 by 2.

As illustrated in FIGS. 13A and 13B, lowering the gray levels for the subpixels in a border area with another subregion by a predetermined decrement reduces the deviation of the actual brightness of the subpixels in the border area from the brightness specified by the gray levels. As a result, the differences in brightness among the regions that should not exist can be made small.

In supplying data signals to the pixel row including the pixel group 255A or the pixel row including the pixel group 255B, the potentials of the data lines change significantly from the ones in supplying data signals to the previous pixel row. For this reason, insufficient write to compensate for the driving load for the data lines affects the brightness, causing the actual brightness to deviate from the brightness specified by the gray levels.

The gray level correction unit 408 compares brightness distributions in a plurality of pixel rows to appropriately correct the gray levels of the subpixels in a border area. For example, the gray level correction unit 408 holds gray level correction tables for a pixel row not anticipated to show deviation of brightness, for a pixel row anticipated to show deviation of brightness, and for a pixel row in a border area. Each gray level correction table associates the classes of gray level ranges with correction amounts as described above.

A pixel row anticipated to show deviation of brightness can be identified as described above. A pixel row in a border area can be identified by comparing the brightness distributions in two consecutive pixel rows. Whether the actual brightness in the pixel row in the border area becomes higher or lower than the brightness specified by the gray level can be determined by comparison with the brightness distribution of the previous pixel row.

As described with reference to FIGS. 13A and 13B, the gray level correction unit 408 corrects gray levels in a pixel row not anticipated to show deviation of brightness. The correction to the gray levels is based on the correction amounts assigned to the classes of gray level ranges, as described above.

The gray level correction unit 408 holds a gray level correction table for a pixel row in a border area where the brightness is anticipated to become higher and a gray level correction table for a pixel row in a border area where the brightness is anticipated to become lower. As described above, the decrement for the border area where the brightness is anticipated to become higher is large and the decrement for the border area where the brightness is anticipated to become lower is small. Although the foregoing example is configured to lower the gray levels of subpixels, the gray levels of some subpixels can be raised.

As described above, the gray level correction unit 408 determines the correction amounts to the gray levels for the subpixels in one target subpixel row from the gray levels for three consecutive subpixel rows including the target subpixel row. The memory area required for the correction is a size for several subpixel rows and therefore, the correction can be achieved without preparing a large storage area like a frame memory in the driver IC 134.

As described above, the driver IC 134 corrects the gray levels appropriately to the brightness distribution (distribution of gray levels) in the image to be displayed. In an example, the driver IC 134 can have a function to adjust the peak brightness in the display region 125. The driver IC 134 adjusts the peak brightness independently from the correction of gray levels. For example, the driver IC 134 adjusts the peak brightness by adjusting the power supply potential VEE in accordance with the configuration data input from the external.

In an example, the function of the gray level correction unit 408 can be switchable between ON and OFF. The driver IC 134 turns ON/OFF the gray level correction unit 408 in accordance with the mode selection from the external. As a result, an image that meets the user's request can be displayed. When the gray level correction unit 408 is OFF, data indicating the gray levels from the gamma correction unit 406 is supplied to the source driver 427. The gray level correction unit 408 can be configured to perform only part or all of the above-described ways of correction to the gray levels.

As set forth above, embodiments of this disclosure have been described; however, this disclosure is not limited to the foregoing embodiments. Those skilled in the art can easily modify, add, or convert each element in the foregoing embodiments within the scope of this disclosure. A part of the configuration of one embodiment can be replaced with a configuration of another embodiment or a configuration of an embodiment can be incorporated into a configuration of another embodiment.

What is claimed is:

1. A display device, comprising:

a display panel; and a control circuit that processes a signal for the display panel, wherein the control circuit is configured to:

acquire respective gray levels specifying brightness for a plurality of subpixels in three or fewer subpixel rows including one subpixel row, and store the gray levels in a memory;

determine correction amounts to the gray levels for subpixels of the one subpixel row based on a distribution of the gray levels for the plurality of subpixels and the gray levels for the subpixels of the one subpixel row without referring to gray levels for any subpixel row other than the three or fewer subpixel rows; and correct the gray levels for the subpixels of the one subpixel row by the correction amounts, wherein a plurality of class sets each including a different number of classes of gray levels are defined, wherein each class in each of the plurality of class sets is assigned a correction amount, and wherein the control circuit is further configured to:

calculate a predetermined indicator from gray levels for the subpixels of the one subpixel row;

select one class set from the plurality of class sets based on the indicator; and determine correction amounts to the gray levels for the subpixels of the one subpixel row based on the selected one class set.

2. The display device according to claim 1, wherein the classes are defined by dividing a full range of the gray levels, and each one of the classes is assigned a decrement, wherein the assigned decrements become smaller from a brightest class to a darkest class, and wherein the control circuit is further configured to lower the gray level for each of the subpixels of the one subpixel row by the decrement assigned to a class that includes the gray level for the subpixel.

3. The display device according to claim 2, wherein the decrement assigned to the darkest class in the plurality of classes is 0.

4. The display device according to claim 1, wherein the subpixels of the one subpixel row include one or two first subpixel groups each composed of consecutive subpixels at a highest gray level and a second subpixel group composed of consecutive subpixels at a lowest gray level, and wherein the control circuit is further configured to lower the gray level for the first subpixel group by a predetermined decrement.

5. The display device according to claim 1, wherein the indicator indicates an average of brightness among the subpixels of the one subpixel row.

6. The display device according to claim 1, wherein the subpixels of the one subpixel row include one or two first subpixel groups each composed of consecutive subpixels at a highest gray level and a second subpixel group composed of consecutive subpixels at a lowest gray level, and wherein the indicator indicates the proportion of the second subpixel group in the subpixels of the one subpixel row.

7. The display device according to claim 1, wherein the control circuit is included in a driver integrated circuit configured to generate data signals based on an image signal received from an external source and output the generated data signals to the display panel.

8. The display device according to claim 1, wherein the control circuit is further configured to determine correction amounts to the gray levels for the subpixels of the one subpixel row without referring to gray levels for any subpixel row other than the one subpixel row.

9. The display device according to claim 1, wherein the control circuit is further configured to:

display a second subpixel row subsequently to a first subpixel row; and determine correction amounts to gray levels for subpixels in the second subpixel row based on a result of comparison of a distribution of gray levels for the second subpixel row with a distribution of gray levels for the first subpixel row.

10. The display device according to claim 1, wherein the control circuit is further configured to acquire gray levels for subpixels in a third subpixel row, a fourth subpixel row next to the third subpixel row, and a fifth subpixel row next to the fourth subpixel row, wherein the third subpixel row is composed of subpixels at the highest gray level, wherein the fourth subpixel row includes one or two third subpixel groups each composed of consecutive subpixels at the highest gray level and a fourth subpixel group composed of consecutive subpixels at the lowest gray level, wherein the fifth subpixel row includes one or two fifth subpixel groups each composed of consecutive subpixels at the highest gray level and a sixth subpixel group composed of consecutive subpixels at the lowest gray level, wherein a distribution of gray levels for the subpixels in the fourth subpixel row is identical to a distribution of gray levels for the subpixels in the fifth subpixel row, wherein the control circuit is yet further configured to:

lower the gray levels for the subpixels in the third subpixel row by a first decrement;

lower the gray levels for the subpixels in the third subpixel groups in the fourth subpixel row by a second decrement; and lower the gray levels for the subpixels in the fifth subpixel groups in the fifth subpixel row by a third decrement, wherein the second decrement is larger than both of the first decrement and the third decrement, and wherein the first decrement is smaller than both of the second decrement and the third decrement.

11. The display device according to claim 1, wherein the control circuit is further configured to acquire gray levels for subpixels in a sixth subpixel row, a seventh subpixel row next to the sixth subpixel row, and an eighth subpixel row next to the seventh subpixel row, wherein the sixth subpixel row includes one or two seventh subpixel groups each composed of consecutive subpixels at the highest gray level and an eighth subpixel group composed of consecutive subpixels at the lowest gray level, wherein the seventh subpixel row is composed of subpixels at the highest gray level, wherein the eighth subpixel row is composed of subpixels at the highest gray level, wherein the control circuit is yet further configured to:

lower the gray levels for the subpixels in the seventh subpixel group in the sixth subpixel row by a fourth decrement;

lower the gray levels for the subpixels in the seventh subpixel row by a fifth decrement; and lower the gray levels for the subpixels in the eighth subpixel row by a sixth decrement, wherein the fifth decrement is smaller than both of the fourth decrement and the sixth decrement, and wherein the fourth decrement is larger than both of the fifth decrement and the sixth decrement.

12. The display device according to claim 1, wherein the control circuit is further configured to simultaneously output data signals to the subpixels of the one subpixel row.

13. A method of correcting data for an image in a display device, the method comprising:

acquiring respective gray levels specifying brightness for a plurality of subpixels in three or fewer subpixel rows including one subpixel row, and store the gray levels in a memory;

determining correction amounts to the gray levels for subpixels of the one subpixel row based on a distribution of the gray levels for the plurality of subpixels and the individual gray levels for the subpixels of the one subpixel row;

correcting the gray levels for the subpixels of the one subpixel row by the correction amounts;

defining a plurality of class sets each including a different number of classes of gray levels, each class in each of the plurality of class sets being assigned a correction amount;

calculating a predetermined indicator from gray levels for the subpixels of the one subpixel row;

selecting one class set from the plurality of class sets based on the indicator; and determining correction amounts to the gray levels for the subpixels of the one subpixel row based on the selected one class set.

14. A display device, comprising:

a display panel; and a control circuit that processes a signal for the display panel, wherein the control circuit is configured to:

acquire respective gray levels specifying brightness for a plurality of subpixels in one subpixel row, and store the gray levels in a memory;

determine correction amounts to the gray levels for the plurality of subpixels based on a distribution of the gray levels and the gray levels for the plurality of subpixels; and correct the gray levels for the plurality of subpixels by the correction amounts, wherein the control circuit is further configured to acquire gray levels for subpixels in a first subpixel row, a second subpixel row next to the first subpixel row, and a third subpixel row next to the second subpixel row, wherein the first subpixel row is composed of subpixels at the highest gray level, wherein the second subpixel row includes one or two first subpixel groups each composed of consecutive subpixels at the highest gray level and a second subpixel group composed of consecutive subpixels at the lowest gray level, wherein the third subpixel row includes one or two third subpixel groups each composed of consecutive subpixels at the highest gray level and a fourth subpixel group composed of consecutive subpixels at the lowest gray level, wherein a distribution of gray levels for the subpixels in the second subpixel row is identical to a distribution of gray levels for the subpixels in the third subpixel row, wherein the control circuit is yet further configured to:

lower the gray levels for the subpixels in the first subpixel row by a first decrement;

lower the gray levels for the subpixels in the first subpixel groups in the second subpixel row by a second decrement; and lower the gray levels for the subpixels in the third subpixel groups in the third subpixel row by a third decrement, wherein the second decrement is larger than both of the first decrement and the third decrement, and wherein the first decrement is smaller than both of the second decrement and the third decrement.

* * * * *